US010069246B1

(12) United States Patent
Moritake et al.

(10) Patent No.: US 10,069,246 B1
(45) Date of Patent: Sep. 4, 2018

(54) CONNECTOR ASSEMBLY

(71) Applicants: Japan Aviation Electronics Industry, Limited, Tokyo (JP); JAE Electronics, Inc., Irvine, CA (US)

(72) Inventors: Toshiyuki Moritake, Irvine, CA (US); Tatsuya Shioda, Tokyo (JP)

(73) Assignees: Japan Aviation Electronics Industry, Limited, Tokyo (JP); JAE Electronics, Inc., Irvine, CA (US)

( * ) Notice: Subject to any disclaimer, the term of this patent is extended or adjusted under 35 U.S.C. 154(b) by 0 days.

(21) Appl. No.: 15/628,132

(22) Filed: Jun. 20, 2017

Related U.S. Application Data

(60) Provisional application No. 62/466,121, filed on Mar. 2, 2017.

(51) Int. Cl.
*H01R 13/645* (2006.01)
*H01R 13/631* (2006.01)
*H01R 13/642* (2006.01)
*H01R 13/627* (2006.01)

(52) U.S. Cl.
CPC ..... *H01R 13/645* (2013.01); *H01R 13/6271* (2013.01); *H01R 13/6315* (2013.01); *H01R 13/642* (2013.01)

(58) Field of Classification Search
CPC ..... H01R 13/6485; H01R 13/6315; H01R 13/642
USPC ..... 439/248
See application file for complete search history.

(56) References Cited

U.S. PATENT DOCUMENTS 5,073,127 A * 12/1991 Daly ..... H01R 23/661 439/473
6,503,108 B1 * 1/2003 Kikuchi ..... H01R 13/506 439/358
6,688,913 B2 * 2/2004 Li ..... H01R 23/6873 439/541.5
7,008,262 B2 * 3/2006 Tsai ..... H01R 13/514 439/465
7,753,724 B2 * 7/2010 Gong ..... H01R 12/58 439/541.5
7,967,631 B2 * 6/2011 Wang ..... H01R 13/502 439/541.5
8,105,103 B2 * 1/2012 Nishio ..... H01R 4/305 439/287
8,672,708 B2 * 3/2014 Ritter ..... H01R 13/514 439/247

(Continued)

FOREIGN PATENT DOCUMENTS

WO WO 2016/137486 A1 9/2016
WO WO 2016137486 A1 * 9/2016

*Primary Examiner* — Alexander Gilman
(74) *Attorney, Agent, or Firm* — Muncy, Geissler, Olds, & Lowe, P.C.

(57) ABSTRACT

A connector assembly includes a first connector having a convex portion at a side surface in a direction perpendicular to a direction of connection and a second connector having a concave portion at a side surface in the direction perpendicular to the direction of connection, the convex portion of the first connector being fitted into the concave portion of the second connector to join the first connector and the second connector together, only one of the first connector and the second connector including a floating mechanism that allows floating operations in directions perpendicular to the direction of connection.

7 Claims, 13 Drawing Sheets

(56) References Cited

U.S. PATENT DOCUMENTS

| | | | | |
|---|---|---|---|---|
| 8,808,029 | B2 * | 8/2014 | Castillo | H01R 13/6585 439/607.05 |
| 8,968,008 | B2 * | 3/2015 | Chang | H01R 12/52 439/74 |
| 9,172,174 | B2 * | 10/2015 | Tsai | H01R 13/516 |
| 9,711,901 | B2 * | 7/2017 | Scholeno | H01R 12/712 |

* cited by examiner

CONNECTOR ASSEMBLY

BACKGROUND OF THE INVENTION

The present invention relates to a connector assembly, and more specifically relates to a connector assembly including two detachable connectors.

A connector assembly that includes a plurality of connectors and is capable of connecting the plurality of connectors with a plurality of counter connectors at a time has conventionally been used. For example, WO 2016/137486 discloses a connector assembly including a plurality of connectors of the same shape as illustrated in FIG. 24 and FIG. 25. Each connector includes a housing 1 having four surfaces parallel to a direction D1 in which the connector is to be connected, and has fitting sections 2, 3, 4, and 5 at the four surfaces of the housing 1, respectively. The fitting sections 2 and 3 are disposed to be oriented opposite to the fitting sections 4 and 5, respectively.

Convex portions 2A, 3A, 4A, and 5A, and concave portions 2B, 3B, 4B, and 5B are formed at the fitting sections 2 to 5 of each connector, respectively. The convex portions 2A and the concave portion 2B of the fitting section 2 and the concave portions 4B and the convex portion 4A of the fitting section 4 have such shapes as to be fitted to each other, respectively, and the convex portion 3A and the concave portions 3B of the fitting section 3 and the concave portion 5B and the convex portions 5A of the fitting section 5 have such shapes as to be fitted to each other, respectively. The convex portions and the concave portions formed at the fitting sections 2 to 5, respectively, are made of a material that allows them to be attracted to each other by magnetic force.

As illustrated in FIG. 26, the plurality of connectors having the above-described fitting sections 2 to 5, respectively, can be joined so that the fitting sections 2 and 3 are fitted to the fitting sections 4 and 5, respectively. In this process, the convex portions and the concave portions of the adjacent connectors are attracted to each other by magnetic force to fix the joining positions of the plurality of connectors, thus forming the connector assembly.

Incidentally, the plurality of connectors included in the connector assembly disclosed in WO 2016/137486 and not-shown counter connectors may have dimensional tolerances generated at the time of manufacture and assembly. In the connector assembly disclosed in WO 2016/137486, each of the plurality of connectors included in the connector assembly is fixed at a predetermined position. Therefore, when the dimensional tolerances take place at the plurality of connectors included in the connector assembly and their counter connectors, the connector assembly may not be connected to their counter connectors due to positional deviation that may take place between the plurality of connectors included in the connector assembly and their counter connectors.

SUMMARY OF THE INVENTION

The present invention has been made to solve the conventional problem as described above, and an object of the present invention is to provide a connector assembly capable of connecting a plurality of connectors to counter connectors even when the plurality of connectors included in the connector assembly and their counter connectors have dimensional tolerances.

A connector assembly according to the present invention comprising two connectors, each of which has a connecting section with a counter connector at a front end part, and is detachable in parallel toward a direction of connection with the counter connector, the connectors comprising: a first connector having a convex portion at a side surface in a direction perpendicular to the direction of connection; and a second connector having a concave portion at a side surface in the direction perpendicular to the direction of connection, wherein the convex portion of the first connector is fitted into the concave portion of the second connector to join the first connector and the second connector together, and wherein only one of the first connector and the second connector includes a floating mechanism that allows floating operations in directions perpendicular to the direction of connection.

DETAILED DESCRIPTION OF THE INVENTION

First Embodiment

Embodiments of the invention are described below with reference to the accompanying drawings.

Figure 1:
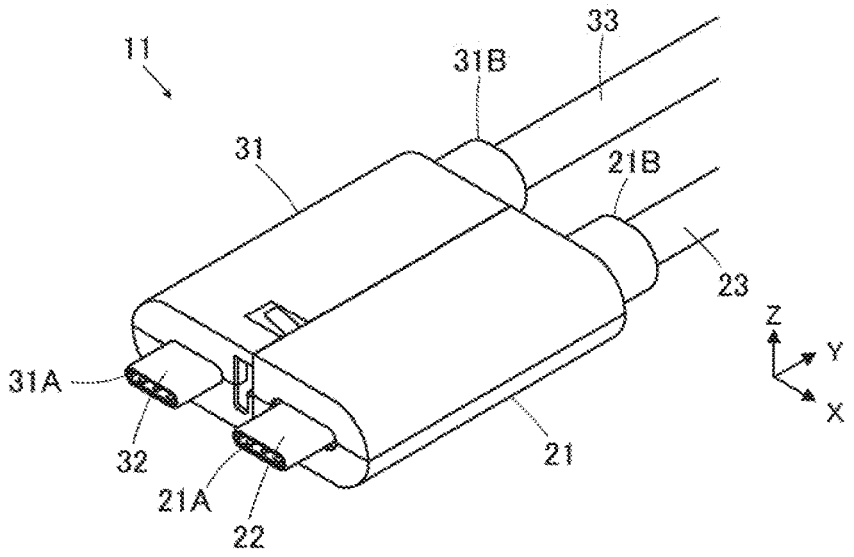
FIG. 1 is a perspective view of a connector assembly according to a first embodiment of the invention.

FIG. 1 is a perspective view of a connector assembly 11 according to a first embodiment. The connector assembly 11 includes a first connector 21 and a second connector 31 joined in parallel to each other. The connectors 21 and 31 have sections 22 and 32 for connecting with counter connectors (not shown) at their front end parts 21A and 31A, respectively. Cables 23 and 33 are connected to rear end parts 21B and 31B of the first connector 21 and the second connector 31, respectively.

For convenience, a direction in which the connectors of the connector assembly 11 are connected to the counter connectors is referred to as "Y direction", a direction extending from the front end parts 21A and 31A to the rear end parts 21B and 31B is particularly referred to as "+Y direction", and a direction extending from the second connector 31 to the first connector 21 is referred to as "+X direction". A direction perpendicular to the X and Y directions is referred to as "Z direction".

Figure 2:
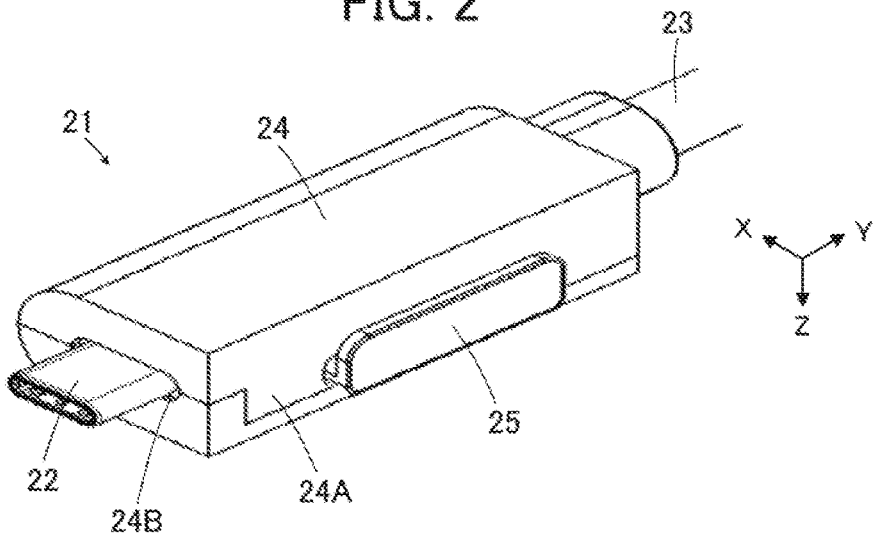
FIG. 2 is a perspective view of a first connector included in the connector assembly according to the first embodiment.
Figure 3:
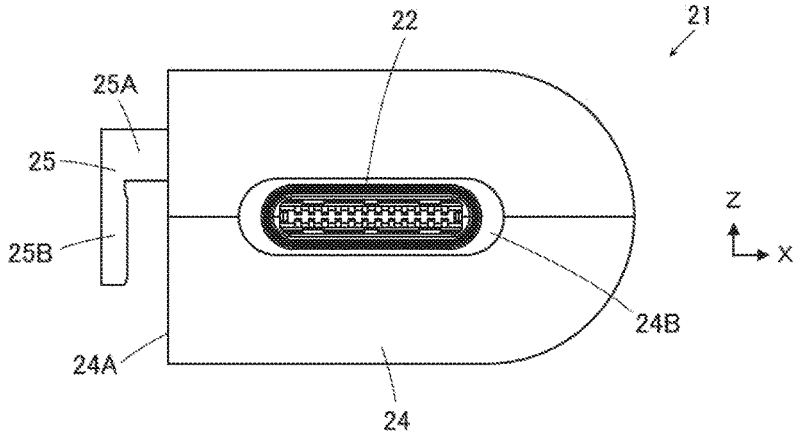
FIG. 3 is a front view of the first connector included in the connector assembly according to the first embodiment when viewed from a direction in which the connector is to be connected.

FIG. 2 illustrates a perspective view of the first connector 21 included in the connector assembly 11. The first connector 21 has a housing 24, and a face 24A for joining to the second connector 31 is formed at the −X direction-side surface of the housing 24. The housing 24 is made of, for example, an insulating resin material. The housing 24 has a protrusion 25 formed as a convex portion protruding in the −X direction from the joining face 24A and extending along the Y direction. FIG. 3 is a front view of the first connector 21 when viewed from a −Y direction. As illustrated in FIG. 3, the protrusion 25 of the first connector 21 includes a base portion 25A protruding in the −X direction from the joining face 24A of the housing 24, and a plate-like portion 25B extending from the base portion 25A in a −Z direction. As illustrated in FIG. 2 and FIG. 3, a front end opening 24B is formed at an end of the housing 24 in the −Y direction so as to allow a space having a predetermined distance around the connecting section 22.

Figure 4:
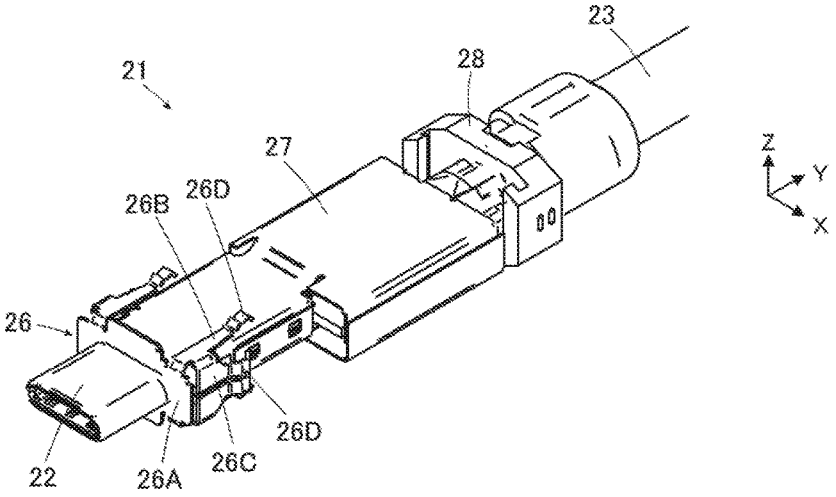
FIG. 4 is a perspective view illustrating a state in which a housing is removed from the first connector included in the connector assembly according to the first embodiment.

FIG. 4 illustrates the first connector 21 from which the housing 24 is removed. As illustrated in FIG. 4, the first connector 21 includes a metallic floating member 26 coupled to an end of the connecting section 22 in the +Y direction, a connector main body 27 coupled to the connecting section 22, and a cable coupling section 28 for connecting the connector main body 27 to the cable 23. The connector main body 27 and the cable coupling section 28 are loosely coupled to each other only with a wiring group (not shown), which allows mutual relative displacements in the X direction and the Z direction within predetermined ranges.

The floating member 26 coupled to the connecting section 22 of the first connector 21 includes a latch plate portion 26A extending in a plate shape along an XZ plane, four first arm portions 26B extending in the +Y direction along an XY plane, and four second arm portions 26C extending in the +Y direction along a YZ plane. The four first arm portions 26B are coupled to the latch plate portion 26A, and include two arm portions disposed so as to face each other on the +Z direction-side surface of the connector main body 27, and two arm portions disposed so as to face each other on the −Z direction-side surface of the connector main body 27. Each of the four second arm portions 26C is coupled to a proximal portion of the corresponding first arm portion 26B, and the four second arm portions 26C include two arm portions disposed so as to face each other on the +X direction-side surface of the connector main body 27, and two arm portions disposed so as to face each other on the −X direction-side surface of the connector main body 27.

Bent portions 26D are formed at ends in the +Y direction of the four first arm portions 26B and the four second arm portions 26C, respectively, the bent portions 26D extending from the first arm portions 26B and the second arm portions 26C, respectively, and each being bent to form a convex shape toward a direction away from the connector main body 27.

Figure 5:
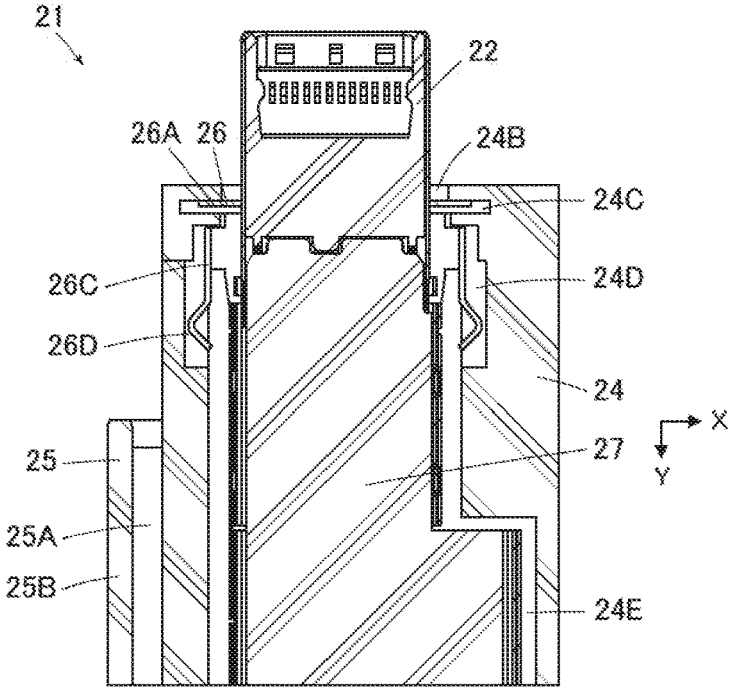
FIG. 5 is a partial sectional plan view of the first connector included in the connector assembly according to the first embodiment.
Figure 6:
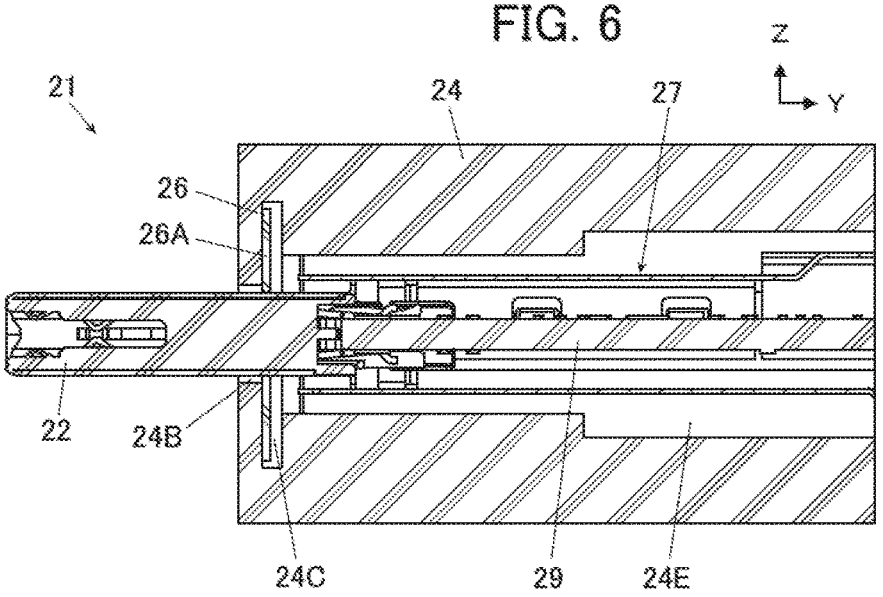
FIG. 6 is a partial sectional side view of the first connector included in the connector assembly according to the first embodiment.

FIG. 5 is a partial sectional plan view of a section obtained by cutting the first connector 21 along a plane parallel to an XY plane when viewed from the +Z direction. FIG. 6 is a partial sectional side view of the first connector 21 cut along a plane parallel to a YZ plane when viewed from the −X direction. As illustrated in FIG. 5 and FIG. 6, accommodation chambers for accommodating a part of the connecting section 22, the floating member 26, and the connector main body 27 are formed inside the housing 24 of the first connector 21, respectively. More specifically, a latch plate accommodating chamber 24C for accommodating the latch plate portion 26A of the floating member 26, an arm accommodating chamber 24D for accommodating the first arm portions 26B and the second arm portions 26C as well as the bent portions 26D formed at the arm portions 26B and 26C, respectively, and a main body accommodating chamber 24E for accommodating the connector main body 27 are formed inside the housing 24.

Figure 7:
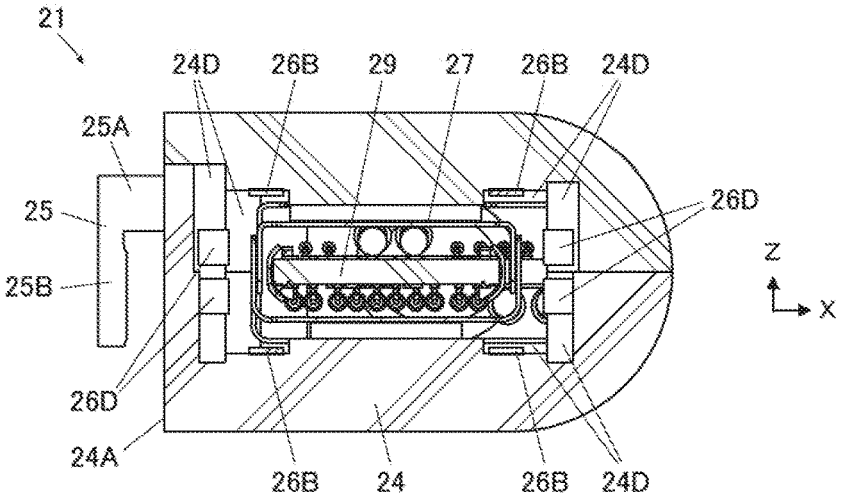
FIG. 7 is a sectional front view of the first connector included in the connector assembly according to the first embodiment.

As illustrated in FIG. 5 and FIG. 6, the latch plate accommodating chamber 24C is formed so that gaps having predetermined lengths in the X direction and the Z direction, respectively, may be provided around the latch plate portion 26A of the floating member 26. FIG. 7 illustrates a sectional front view of the first connector 21 cut along a plane that passes through the bent portions 26D formed at the second arm portions 26C and is parallel to the XZ plane. As illustrated in FIG. 7, the arm accommodating chamber 24D is formed so that gaps may be provided in the +X direction and the −X direction around the first arm portions 26B of the floating member 26 and gaps may be provided in the +Z direction and the −Z direction around the second arm portions 26C.

As illustrated in FIG. 5 and FIG. 6, the main body accommodating chamber 24E is formed so that gaps having predetermined lengths in the X direction and the Z direction, respectively, may be provided around the connector main body 27.

As illustrated in FIG. 6 and FIG. 7, the connector main body 27 includes a circuit board 29, which is coupled to the connecting section 22. Unlike the connector main body 27 and the cable coupling section 28, the connecting section 22 and the circuit board 29 are fixed to each other and have no relative displacement.

Having the above-mentioned configuration, the first connector 21 has a floating mechanism that allows the connecting section 22 and the connector main body 27 to perform floating operations in the X direction and the Z direction when external forces in the X direction and the Z direction are applied to the connecting section 22. More specifically, when an external force in the X direction is applied to the connecting section 22, the latch plate portion 26A of the floating member 26 slides inside the latch plate accommodating chamber 24C in the housing 24 in the X direction in which the external force is applied, the four first arm portions 26B slide inside the arm accommodating chamber 24D in the housing 24 in the X direction in which the external force is applied, and then, the connecting section 22 and the connector main body 27 also slide by distances of displacement of the latch plate portion 26A and the two first arm portions 26B in the X direction in which the external force is applied. In this process, of the four second arm portions 26C disposed in the +X direction and the −X direction with respect to the connector main body 27, the two second arm portions 26C disposed in the direction of displacement of the connecting section 22 have their bent portions 26D pushed against the inner wall of the arm accommodating chamber 24D in the housing 24. The second arm portions 26C at which the two bent portions 26D are formed, respectively, thus elastically deform to approach the connector main body 27. Therefore, when the external force in the X direction is no longer applied to the first connector 21, the two second arm portions 26C that deformed elastically are pushed back by elastic force from the inner wall of the arm accommodating chamber 24D in the housing 24 via their respective bent portions 26D, which allows the connecting section 22 and the connector main body 27 to return to their original positions.

When an external force in the Z direction is applied to the connecting section 22, the latch plate portion 26A of the floating member 26 slides inside the latch plate accommodating chamber 24C in the housing 24 in the Z direction in which the external force is applied, the four second arm portions 26C slide inside the arm accommodating chamber 24D in the housing 24 in the Z direction in which the external force is applied, and then, the connecting section 22 and the connector main body 27 also slide by a distance of displacement of the latch plate portion 26A in the Z direction in which the external force is applied. In this process, of the four first arm portions 26B disposed in the +Z direction and the −Z direction with respect to the connector main body 27, respectively, the two first arm portions 26B disposed in the direction of displacement of the connecting section 22 have their bent portions 26D pushed against the inner wall of the arm accommodating chamber 24D in the housing 24. The respective first arm portions 26B at which the two bent portions 26D are formed, thus elastically deform to approach the connector main body 27. Therefore, when the external force in the Z direction is no longer applied to the first connector 21, the two first arm portions 26B that deformed elastically are pushed back by elastic force from the inner wall of the arm accommodating chamber 24D in the housing 24 via their respective bent portions 26D, which allows the connecting section 22 and the connector main body 27 to return to their original positions.

The two first arm portions 26B are disposed on each of the +Z direction side and the −Z direction side of the connector main body 27, and the two second arm portions 26C are disposed on each of the +X direction side and the −X direction side of the connector main body 27. Accordingly, rotation of the floating member 26 with respect to the housing 24 around an axis along the Y direction is suppressed, and rotational motion of the connecting section 22 and the connector main body 27 with respect to the housing 24 is also suppressed.

Figure 8:
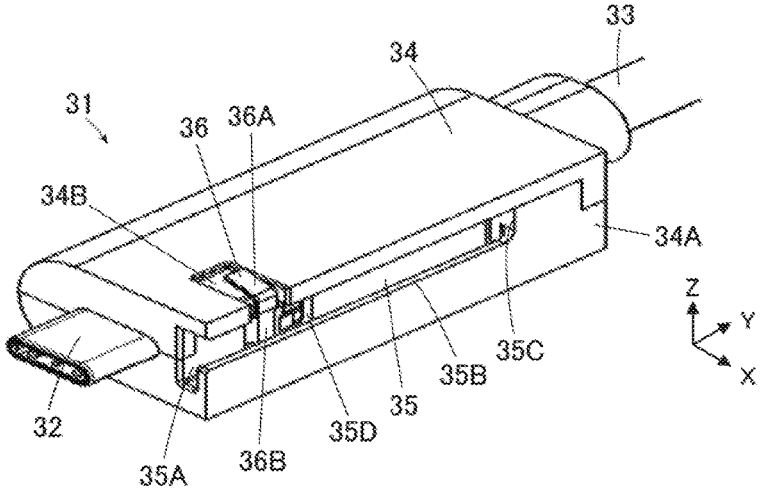
FIG. 8 is a perspective view of a second connector included in the connector assembly according to the first embodiment.

FIG. 8 illustrates a perspective view of the second connector 31 included in the connector assembly 11. The second connector 31 has a housing 34, and a face 34A for joining to the first connector 21 is formed at the +X direction-side surface of the housing 34, and a rectangular recess 34B having an approximately rectangular shape is formed in the +Z direction-side surface of the housing 34 so as to extend to the joining face 34A. The housing 34 is made of, for example, an insulating resin material. Further, a hollow portion 35 that is a recess which is concave from the joining face 34A in the −X direction and extends along the Y direction is formed. The hollow portion 35 includes an insertion opening 35A formed so as to open toward the −Y direction of the housing 34, in other words, toward the connecting section 32 side, a slide rail 35B extending along the Y direction, an abutment portion 35C formed at an end of the slide rail 35B in the +Y direction, and a lateral opening 35D formed underneath the rectangular recess 34B in the −X direction-side surface of the hollow portion 35. Further, a metallic locking spring 36 is provided so as to enter the inside of the housing 34 from the rectangular recess 34B of the housing 34.

Figure 9:
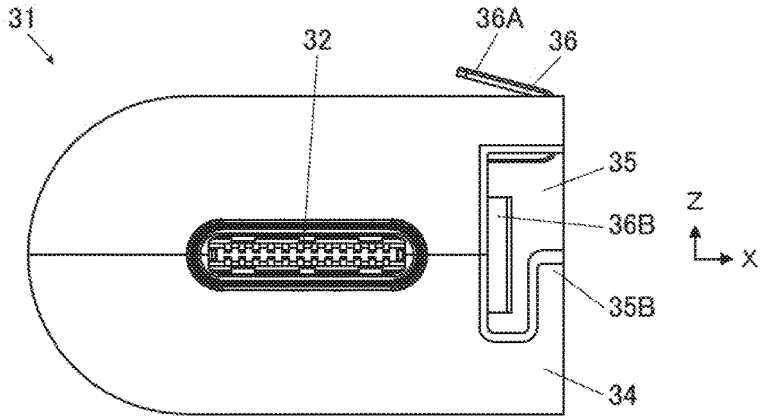
FIG. 9 is a front view of the second connector included in the connector assembly according to the first embodiment when viewed from a direction in which the connector is to be connected.

FIG. 9 is a front view of the second connector 31 when viewed from the −Y direction. As illustrated in FIG. 8 and FIG. 9, the locking spring 36 includes a slide button 36A disposed in the rectangular recess 34B of the housing 34, and a spring bent portion 36B which is bent toward the +X direction to form a convex shape. The spring bent portion 36B protrudes from the lateral opening 35D of the hollow portion 35 toward the inside of the hollow portion 35.

Figure 10:
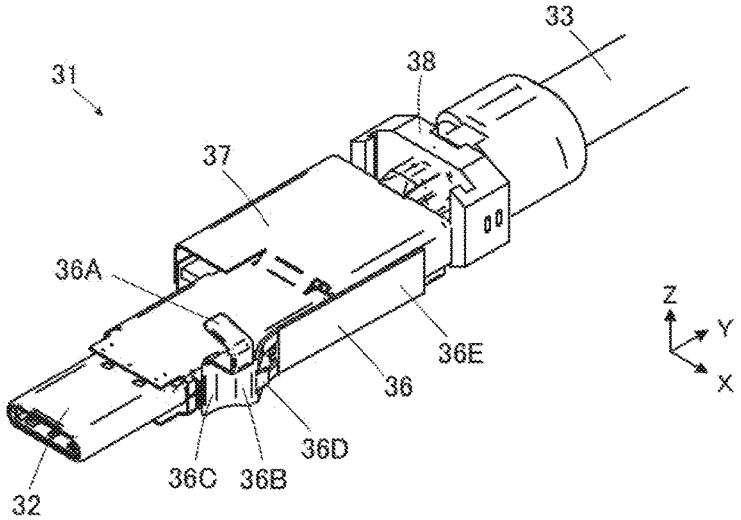
FIG. 10 is a perspective view illustrating a state in which a housing is removed from the second connector included in the connector assembly according to the first embodiment.

FIG. 10 illustrates the second connector 31 from which the housing 34 is removed. As illustrated in FIG. 10, the second connector 31 includes a connector main body 37 coupled to the connecting section 32, and a cable coupling section 38 for connecting the connector main body 37 and the cable 33 to each other.

The locking spring 36 includes a spring front end portion 36C coupled to the slide button 36A and the spring bent portion 36B and disposed along the +X direction-side surface of the connector main body 37, a plate-like stopper portion 36D protruding in the +Y direction from an apex of the spring bent portion 36B, and a plate-like fixed portion 36E coupled to the spring bent portion 36B and extending along the +Y direction.

Figure 11:
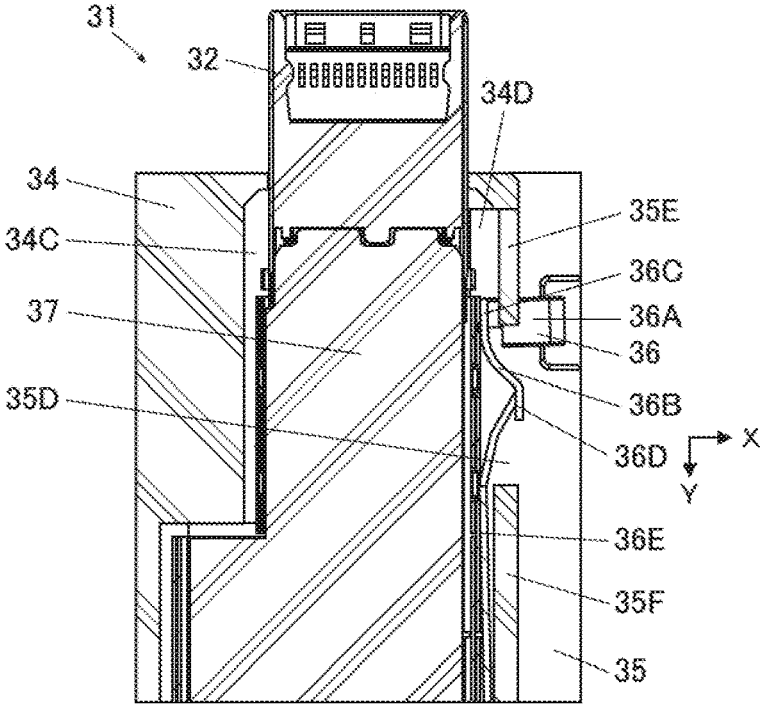
FIG. 11 is a partial sectional plan view of the second connector included in the connector assembly according to the first embodiment.

FIG. 11 is a partial sectional plan view of a section obtained by cutting the second connector 31 along a plane parallel to the XY plane when viewed from the +Z direction. As illustrated in FIG. 11, a main body accommodating chamber 34C for accommodating a part of the connecting section 32 and the connector main body 37 is formed inside the housing 34 of the second connector 31. A front side partitioning portion 35E partitioning into the hollow portion 35 and the main body accommodating chamber 34C in the −Y direction side of the lateral opening 35D, and a rear side partitioning portion 35F partitioning into the hollow portion 35 and the main body accommodating chamber 34C in the +Y direction side of the lateral opening 35D are formed in the hollow portion 35. Further, a gap 34D is formed between the front side partitioning portion 35E and the connector main body 37. The fixed portion 36E of the locking spring 36 is fixed between the rear side partitioning portion 35F and the connector main body 37.

Figure 12:
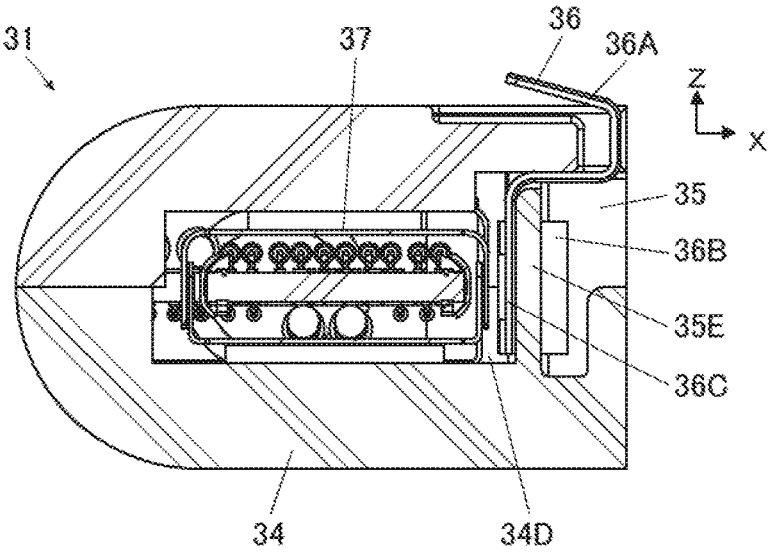
FIG. 12 is a sectional front view of the second connector included in the connector assembly according to the first embodiment.
Figure 13:
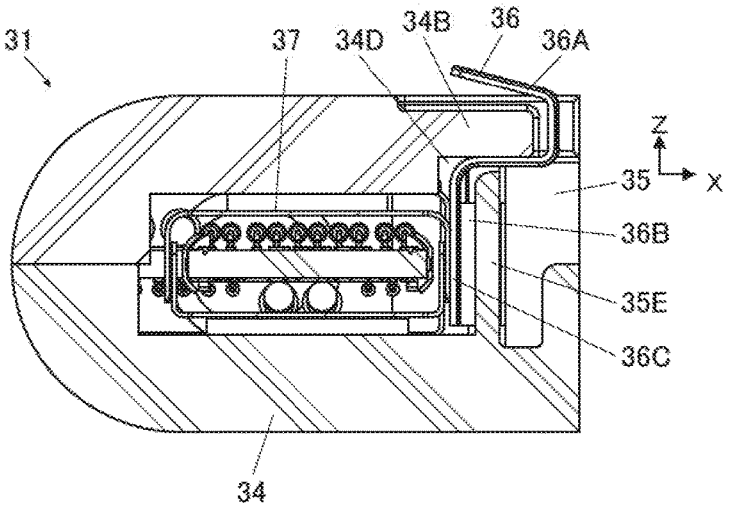
FIG. 13 is a sectional front view of the second connector included in the connector assembly according to the first embodiment in a state in which a slide button has slid.

FIG. 12 is a sectional front view of the second connector 31 cut by a plane being parallel to the XZ plane and passing through the slide button 36A of the locking spring 36 when viewed from the +Y direction. FIG. 13 is a sectional front view of the second connector 31 illustrating a state in which a force in the −X direction is applied to the slide button 36A of the locking spring 36 to make the slide button 36A to slide in the −X direction. As illustrated in FIG. 12, in a state in which a force in the −X direction is not applied to the slide button 36A of the locking spring 36, the spring bent portion 36B of the locking spring 36 protrudes from the lateral opening 35D to the inside of the hollow portion 35. As illustrated in FIG. 13, when the force in the −X direction is applied to the slide button 36A, the slide button 36A slides in the −X direction. In this process, the spring front end portion 36C of the locking spring 36 also slides in the −X direction inside the gap 34D formed between the front side partitioning portion 35E and the connector main body 37, and as a result, the spring bent portion 36B also slides in the −X direction to reach a state in which the spring bent portion 36B does not protrude into the hollow portion 35.

Since the fixed portion 36E of the locking spring 36 is fixed to the rear side partitioning portion 35F of the hollow portion 35, when the force in the −X direction is no longer applied to the slide button 36A, the locking spring 36 is displaced in the +X direction by its own elastic force, and can return to the state as illustrated in FIG. 12 in which the spring bent portion 36B protrudes from the lateral opening 35D to the inside of the hollow portion 35.

The connector assembly 11 illustrated in FIG. 1 can be formed by joining the above-mentioned first connector 21 and second connector 31 to each other. When the connector assembly 11 is to be connected to counter connectors (not shown), of the two connectors 21 and 31 included in the connector assembly 11, the first connector 21 is allowed to perform floating operations in the X direction and the Z direction at the connecting section 22. Therefore, even when the first connector 21 and the second connector 31 as well as the two counter connectors to be connected to the connector assembly 11 have dimensional tolerances, the connector assembly 11 and the two counter connectors can be connected to each other.

As described above, the connector assembly 11 is formed by joining the first connector 21 and the second connector 31 together, and the operation for joining the first connector 21 and the second connector 31 together is now described.

Figure 14:
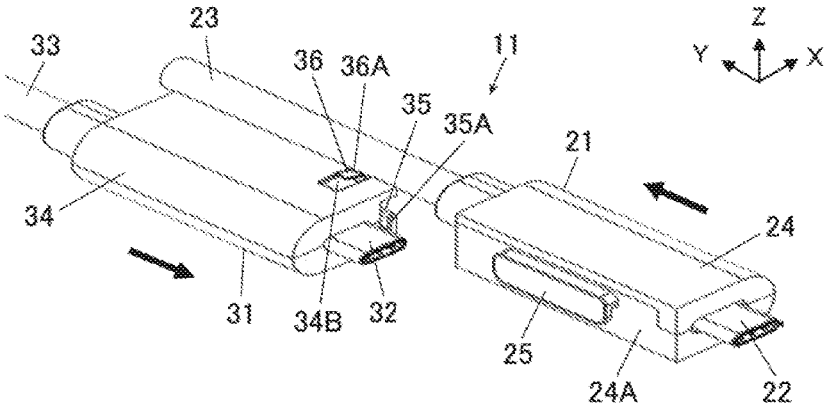
FIG. 14 is a perspective view illustrating a joining operation of the first connector and the second connector included in the connector assembly according to the first embodiment.
Figure 15:
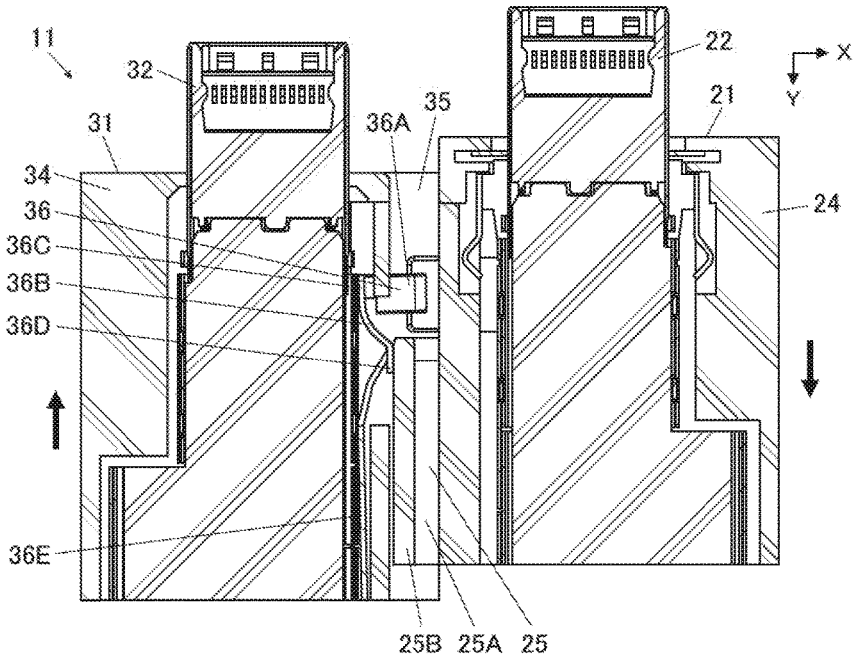
FIG. 15 is a partial sectional plan view of the connector assembly illustrating the joining operation of the first connector and the second connector included in the connector assembly according to the first embodiment.

The first connector 21 and the second connector 31 are joined together by fitting the protrusion 25 of the first connector 21 into the hollow portion 35 of the second connector 31. Therefore, for example, as illustrated in FIG. 14, the first connector 21 and the second connector 31 are positioned on the −Y direction side and the +Y direction side, respectively, and the protrusion 25 of the first connector 21 is inserted into the insertion opening 35A of the hollow portion 35 in the second connector 31. The protrusion 25 of the first connector 21 is inserted into the insertion opening 35A of the hollow portion 35 in the second connector 31, and slides in the +Y direction along the slide rail 35B of the hollow portion 35 to come into contact with the spring bent portion 36B of the locking spring 36. When the protrusion 25 further slides in the +Y direction, as illustrated in FIG. 15, the spring bent portion 36B is pressed by the protrusion 25 to displace in the −X direction while the spring front end portion 36C and the stopper portion 36D coupled to the spring bent portion 36B as well as the slide button 36A coupled to the spring front end portion 36C are displaced in the −X direction.

Figure 16:
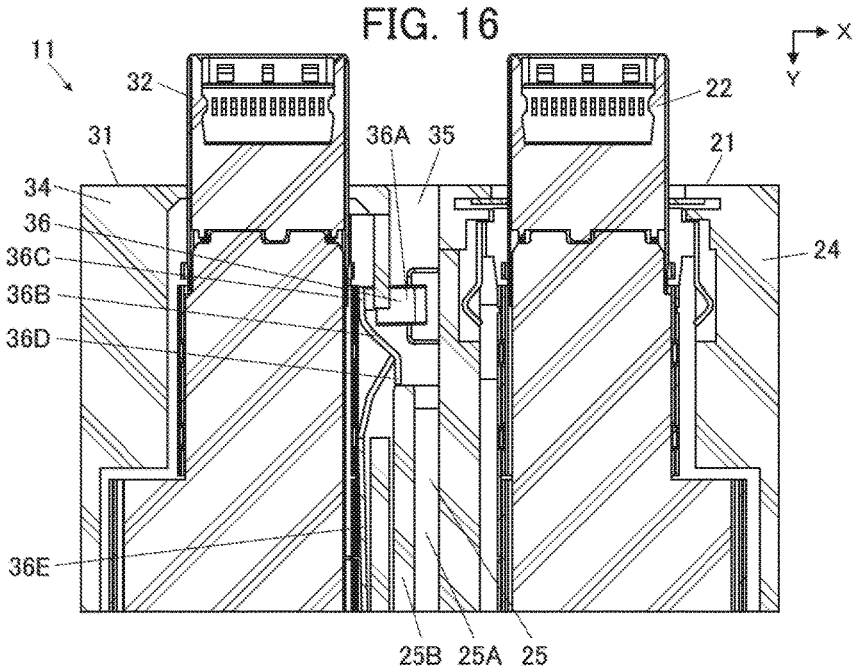
FIG. 16 is a partial sectional plan view of the connector assembly according to the first embodiment.

When the protrusion 25 of the first connector 21 further slides in the +Y direction and abutted against the abutment portion 35C of the hollow portion 35, the joining position of the first connector 21 and the second connector 31 in the Y direction is determined. In this process, an end of the protrusion 25 in the −Y direction is positioned on the +Y direction side of the stopper portion 36D of the locking spring 36, and hence the spring bent portion 36B and the stopper portion 36D are displaced in the +X direction by elastic force of the locking spring 36. Therefore, as illustrated in FIG. 16, the stopper portion 36D of the locking spring 36 comes into contact with the end of the protrusion 25 in the −Y direction and the joining position of the first connector 21 and the second connector 31 can be mechanically fixed.

Figure 17:
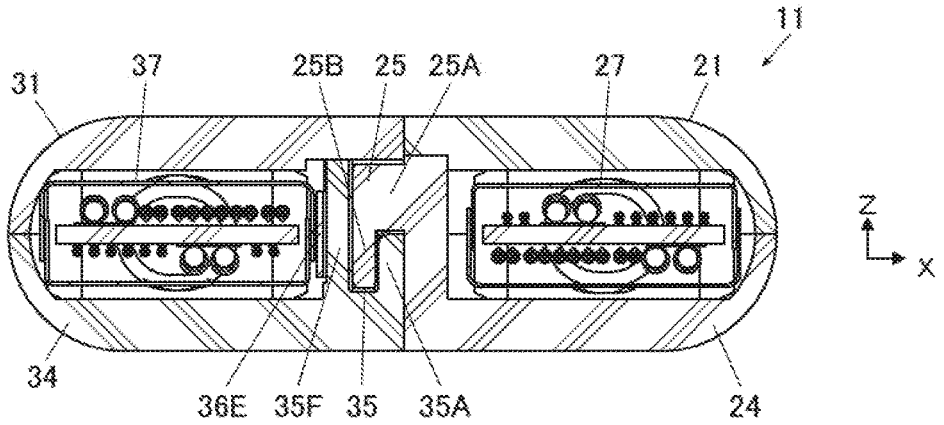
FIG. 17 is a sectional front view of the connector assembly according to the first embodiment.

FIG. 17 is a sectional front view of a section obtained by cutting the connector assembly 11 including the first connector 21 and the second connector 31 joined together along a plane parallel to the XZ plane. As illustrated in FIG. 17, the connector assembly can be formed by firmly joining the first connector 21 and the second connector 31 together. When the first connector 21 and the second connector 31 are to be separated from each other, the slide button 36A of the locking spring 36 of the second connector 31 is made slide in the −X direction to slide the spring bent portion 36B and the stopper portion 36D in the −X direction so that the first connector 21 may be displaced in the −Y direction relative to the second connector 31.

As described above, the protrusion 25 of the first connector 21 is made slide from the insertion opening 35A of the hollow portion 35 formed on the connecting section 32 side of the second connector 31 to join the first connector 21 and the second connector 31 to each other. For example, in a case where the insertion opening 35A is formed at the +Y direction end of the housing 34 in the second connector 31, when the formed connector assembly 11 is to be connected to a counter connector (not shown), the connector assembly 11 is subjected to force in the +Y direction from the counter connector. In this case, the first connector 21 may be displaced on the +Y direction side of the second connector 31, that is, toward the insertion opening 35A to make the protrusion 25 of the first connector 21 be detached from the insertion opening 35A of the second connector 31, thus separating the first connector 21 and the second connector 31 from each other. In the connector assembly 11 according to the first embodiment, the insertion opening 35A is formed at the −Y direction end of the housing 34 in the second connector 31, and the protrusion 25 of the first connector 21 is abutted against the abutment portion 35C in the second connector 31 to determine the joining position of the first connector 21 and the second connector 31 in the Y direction. Therefore, the first connector 21 and the second connector 31 can be prevented from being separated from each other in the connection between the connector assembly 11 and the counter connectors.

The floating member 26 of the first connector 21 includes the four first arm portions 26B and the four second arm portions 26C but the numbers of the first arm portions 26B and the second arm portions 26C are not limited thereto. The numbers of the first arm portions 26B and the second arm portions 26C may be appropriately set as long as the connecting section 22 and the connector main body 27 of the first connector 21 are allowed to perform floating operations in the X direction and the Z direction. For example, the floating member 26 may have one first arm portion 26B, or three or more first arm portions 26B on each of the +Z direction side and the −Z direction side of the connector main body 27. Further, for example, the floating member 26 may have one second arm portion 26C, or three or more second arm portions 26C on each of the +X direction side and the −X direction side of the connector main body 27.

The shape of the floating member 26 in the first connector 21 is not particularly limited as long as the connecting section 22 and the connector main body 27 of the first connector 21 are allowed to perform floating operations in the X direction and the Z direction. For example, each of the second arm portions 26C may not be an extension of the first arm portion 26B but an extension of the latch plate portion 26A in the +Y direction.

Although the first connector 21 where the protrusion 25 is formed has been described as having the floating mechanism, the second connector 31 may have the floating mechanism instead of the first connector 21. However, the inside of the housing needs to have a predetermined volume to have the floating mechanism, and hence the first connector 21 that does not have the hollow portion 35 preferably have the floating mechanism.

Second Embodiment

The first connector 21 and the second connector 31 included in the connector assembly 11 according to the first embodiment are joined to each other by sliding the protrusion 25 of the first connector 21 in the hollow portion 35 of the second connector 31. However, the method of joining the first connector 21 and the second connector 31 to each other is not limited to this method.

Figure 18:
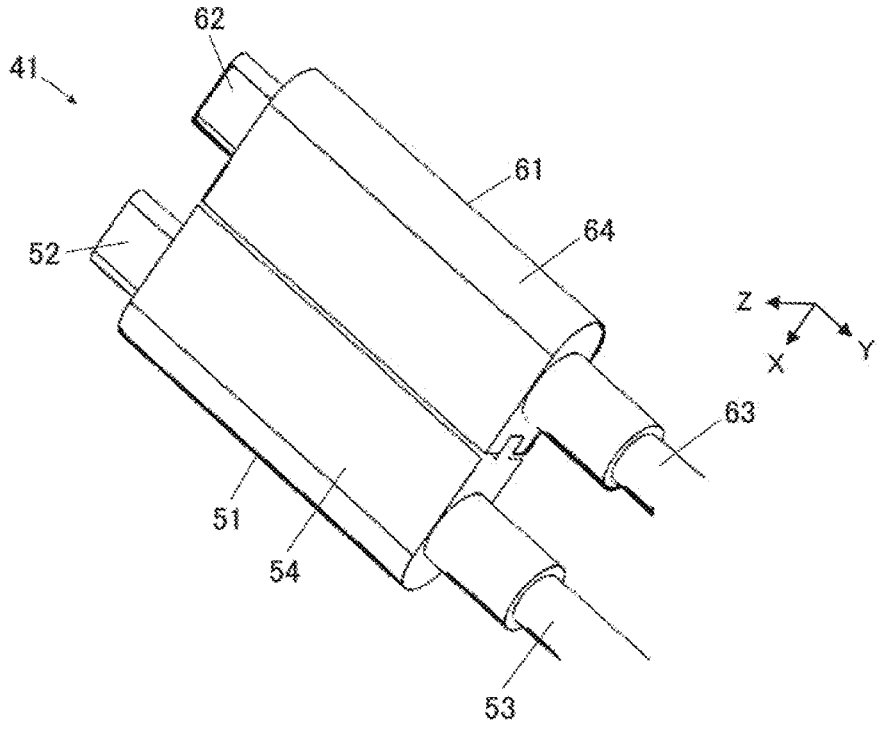
FIG. 18 is a perspective view of a connector assembly according to a second embodiment.

FIG. 18 illustrates a perspective view of a connector assembly 41 according to a second embodiment. As illustrated in FIG. 18, the connector assembly 41 according to the second embodiment is formed by joining a first connector 51 and a second connector 61 together. The first connector 51 and the second connector 61 have connecting sections 52 and 62 at their −Y direction ends, respectively, and cables 53 and 63 are connected to +Y direction ends of the first connector 51 and the second connector 61, respectively. The first connector 51 and the second connector 61 have housings 54 and 64, respectively. The connecting section 52 of the first connector 51 and the connecting section 62 of the second connector 61 are configured in the same manner as the connecting section 22 of the first connector 21 and the connecting section 32 of the second connector 31 in the first embodiment illustrated in FIG. 1, respectively.

The first connector 51 in the second embodiment has a floating mechanism whose configuration is the same as that of the floating mechanism of the first connector 21 in the first embodiment, and elements included in the housing 54 are the same as those included in the housing 24 of the first connector 21 in the first embodiment illustrated in FIG. 5 and FIG. 6. More specifically, although not shown, the first connector 51 according to the second embodiment includes the floating member 26 and the connector main body 27 of the first connector 21 according to the first embodiment illustrated in FIG. 5 and FIG. 6. Although not shown, the second connector 61 according to the second embodiment includes the connector main body 37 of the second connector 31 according to the first embodiment illustrated in FIG. 11.

In the following description, a detailed description of the same components as those of the first connector 21 and the second connector 31 according to the first embodiment is omitted.

Figure 19:
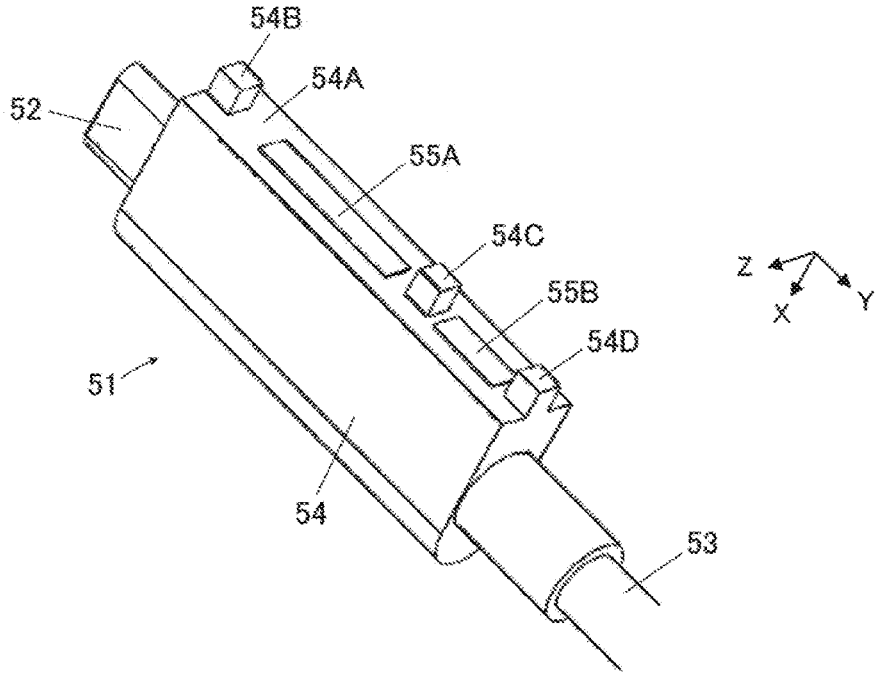
FIG. 19 is a perspective view of a first connector included in the connector assembly according to the second embodiment.

FIG. 19 is a perspective view of the first connector 51 according to the second embodiment. As illustrated in FIG. 19, a face 54A for joining to the second connector 61 is formed at the −X direction-side surface of the housing 54 of the first connector 51. The housing 54 has three protrusions 54B, 54C, and 54D formed in this order along the +Y direction, the protrusions being convex portions protruding in the −X direction from the joining face 54A, respectively. A plate-like first ferromagnetic member 55A which extends in the Y direction along the joining face 54A is attached between the protrusion 54B and the protrusion 54C, and a plate-like second ferromagnetic member 55B which is shorter in the Y direction than the first ferromagnetic member 55A is attached between the protrusion 54C and the protrusion 54D. The three protrusions 54B, 54C, and 54D are the same in size as each other.

Figure 20:
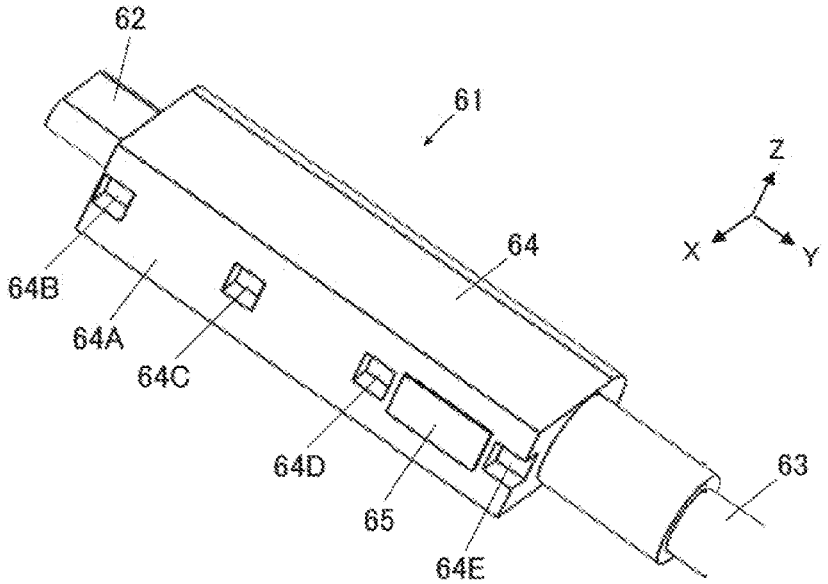
FIG. 20 is a perspective view of a second connector included in the connector assembly according to the second embodiment.

FIG. 20 is a perspective view of the second connector 61 according to the second embodiment. As illustrated in FIG. 20, a face 64A for joining to the first connector 51 is formed at the +X direction-side surface of the housing 64 of the second connector 61. The housing 64 has four protrusion-receiving portions 64B, 64C, 64D, and 64E formed in this order along the +Y direction, the protrusion-receiving portions being concave portions recessed in the −X direction from the joining face 64A, respectively. The four protrusion-receiving portions 64B, 64C, 64D, and 64E are the same in size as each other. The size of each of the protrusion-receiving portions 64B, 64C, 64D, and 64E is slightly larger than the size of each of protrusions 54B, 54C, and 54D of the first connector 51 so that each of the protrusions 54B, 54C, and 54D can be fitted into any one of the protrusion-receiving portions 64B, 64C, 64D, and 64E. A plate-like magnet 65 extending along the joining face 64A is attached between the protrusion-receiving portions 64D and 64E.

The distance between the protrusion-receiving portions 64B and 64D is the same as that between the protrusions 54B and 54C of the first connector 51. The distance between the protrusion-receiving portions 64D and 64E is the same as that between the protrusions 54C and 54D of the first connector 51. The distance between the protrusion-receiving portions 64C and 64E is the same as that between the protrusions 54B and 54C of the first connector 51. Therefore, as illustrated in FIG. 18, the first connector 51 and the second connector 61 can be joined together by fitting the protrusions 54B, 54C, and 54D of the first connector 51 into the protrusion-receiving portions 64B, 64D, and 64E of the second connector 61, respectively. In this process, the ferromagnetic member 55B of the first connector 51 and the magnet 65 of the second connector 61 are attracted to each other by magnetic force. As a result, the joining position of the first connector 51 and the second connector 61 is fixed.

For convenience, the joining position of the first connector 51 and the second connector 61 where the connecting section 52 of the first connector 51 and the connecting section 62 of the second connector 61 are at positions identical to each other in the Y direction, as illustrated in FIG. 18, is called herein "first position".

Figure 21:
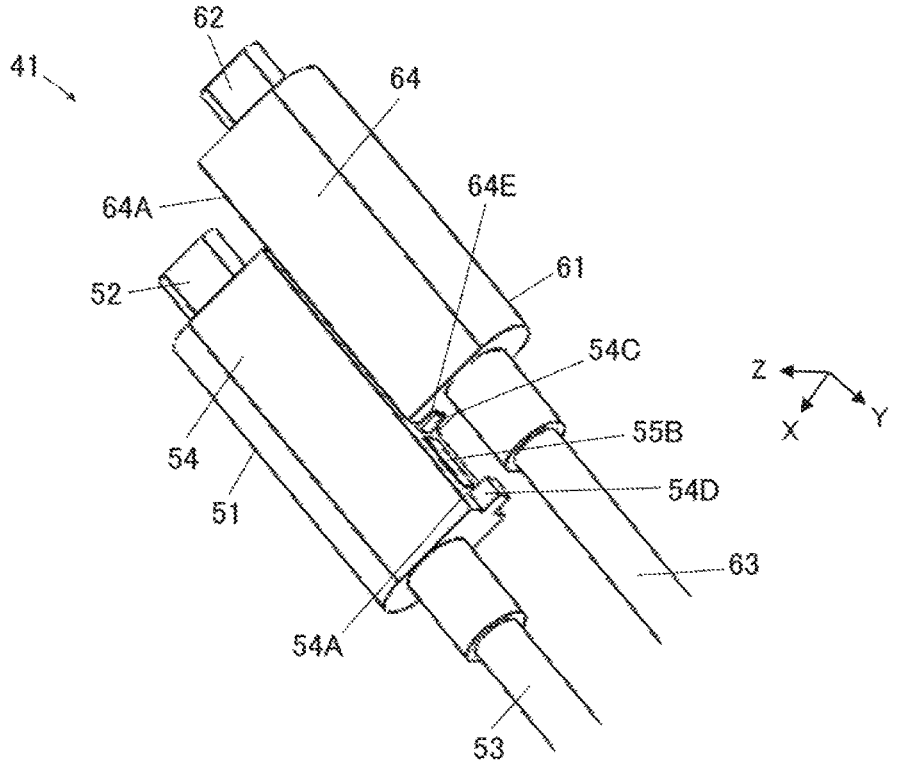
FIG. 21 is a perspective view illustrating a state in which the first connector and the second connector included in the connector assembly according to the second embodiment are joined to each other at a second position.

The protrusions 54B and 54C of the first connector 51 can be fitted into the protrusion-receiving portions 64C and 64E of the second connector 61, respectively. As a result, the first connector 51 and the second connector 61 can be joined to each other at a position as illustrated in FIG. 21. In this process, the ferromagnetic member 55A of the first connector 51 and the magnet 65 of the second connector 61 are attracted to each other by magnetic force to fix the joining position of the first connector 51 and the second connector 61.

For convenience, the joining position of the first connector 51 and the second connector 61 where the connecting section 62 of the second connector 61 is positioned on the −Y direction side of the connecting section 52 of the first connector 51, as illustrated in FIG. 21, is called herein "second position". When, of the two connectors 51 and 61 included in the connector assembly 41, the second connector 61 is only used, the first connector 51 and the second connector 61 are joined to each other at the second position, which can prevent the first connector 51 from hindering the use of the second connector 61.

As described above, in the connector assembly 41 according to the second embodiment, the first connector 51 and the second connector 61 can be joined together with relative ease by fitting the protrusions 54B, 54C, and 54D of the first connector 51 into the protrusion-receiving portions 64B, 64D, and 64E of the second connector 61, respectively. Since the first connector 51 has the floating mechanism, even when the first connector 51 and the second connector 61 as well as two counter connectors to be connected to the connector assembly 41 have dimensional tolerances, the connector assembly 41 and the two counter connectors can be connected to each other.

The protrusions 54B, 54C and 54D of the first connector 51, and the protrusion-receiving portions 64B, 64C, 64D, and 64E of the second connector 61 are located so that the first connector 51 and the second connector 61 can be joined to each other at any of the first position and the second position, and hence the first position and the second position can be used depending on the intended purpose.

According to the description made for the second embodiment, the first connector 51 has the ferromagnetic members 55A and 55B, and the second connector 61 has the magnet 65. However, the first connector 51 and the second connector 61 may have a magnet and ferromagnetic members, respectively, as long as the first connector 51 and the second connector 61 can be attracted to each other by magnetic force. Alternatively, the first connector 51 and the second connector 61 may each have a magnet. In this case, the magnets of the first connector 51 and the second connector 61 are located so that surfaces having magnetic poles different from each other face the −X direction and the +X direction, respectively.

The distance between the protrusion-receiving portion 64B and the protrusion-receiving portion 64C in the second connector 61 is preferably different from the distance between the protrusion-receiving portion 64D and the protrusion-receiving portion 64E. This prevents, for example, the protrusions 54C and 54D of the first connector 51 from being fitted into the protrusion-receiving portions 64B and 64C of the second connector 61, respectively, whereby the first connector 51 and the second connector 61 can be joined together only at the predetermined position.

Figure 22:
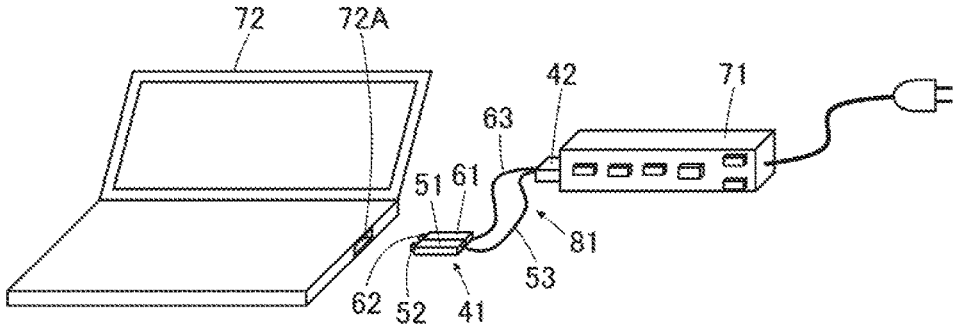
FIG. 22 is a perspective view illustrating an example in which the connector assembly according to the second embodiment is used in a high-capacity personal computer.

Exemplary uses of the connector assembly 41 according to the second embodiment are described below. As illustrated in FIG. 22, the connector assembly 41 can be used in a cable unit 81 connecting a docking station 71 with a personal computer 72. The cable unit 81 has the two cables 53 and 63. The first connector 51 of the connector assembly 41 is connected to one end of the cable 53, and the second connector 61 of the connector assembly 41 is connected to one end of the cable 63; and a connector 42 for the docking station is connected to the other end of each of the cables 53 and 63.

The docking station 71 is, for example, connected to a notebook personal computer mainly for feature expansion of the personal computer including interface addition. Connections with various personal computers are possible, and transmission of information from/to the connected personal computers and supply of power to the personal computers can be made.

The personal computer 72 illustrated in FIG. 22 is a high-capacity notebook personal computer, more specifically a personal computer that can transmit large-capacity information and requires a large amount of power. The personal computer 72 includes a personal computer side connector 72A capable of simultaneously connecting with the connecting sections 52 and 62 of the first connector 51 and the second connector 61 included in the connector assembly 41, respectively. When the cable unit 81 is to be connected to the personal computer side connector 72A of the personal computer 72, the connecting sections 52 and 62 of the first connector 51 and the second connector 61 can be simultaneously connected to the personal computer side connector 72A of the personal computer 72 in a state in which the first connector 51 and the second connector 61 are joined to each other at the first position. This allows high-capacity transmission between the docking station 71 and the personal computer 72.

Figure 23:
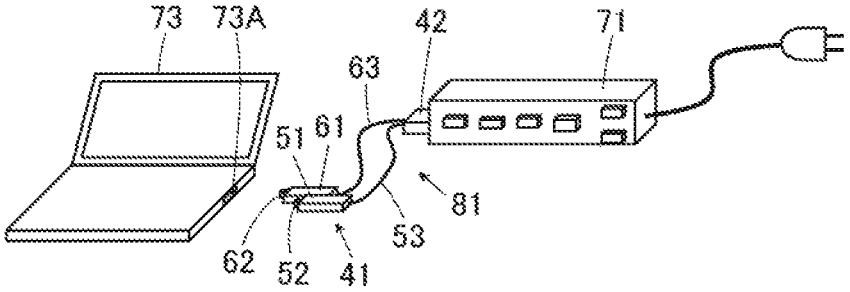
FIG. 23 is a perspective view illustrating an example in which the connector assembly according to the second embodiment is used in a low-capacity personal computer.
Figure 24:
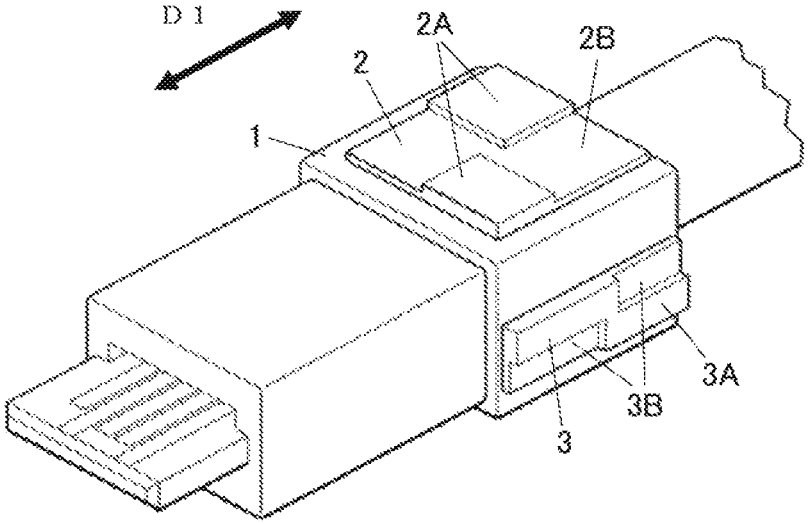
FIG. 24 PRIOR ART
FIG. 24 is a perspective view of a connector included in a conventional connector assembly disclosed in WO 2016/137486 when viewed from the front side.
Figure 25:
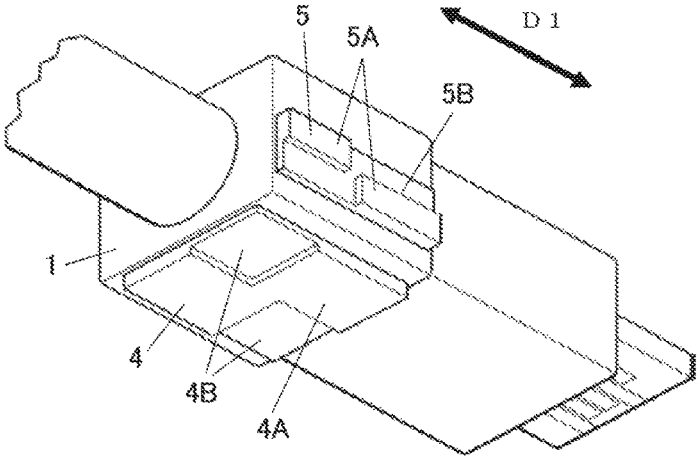
FIG. 25 PRIOR ART
FIG. 25 is a perspective view of the connector included in the conventional connector assembly disclosed in WO 2016/137486 when viewed from behind.
Figure 26:
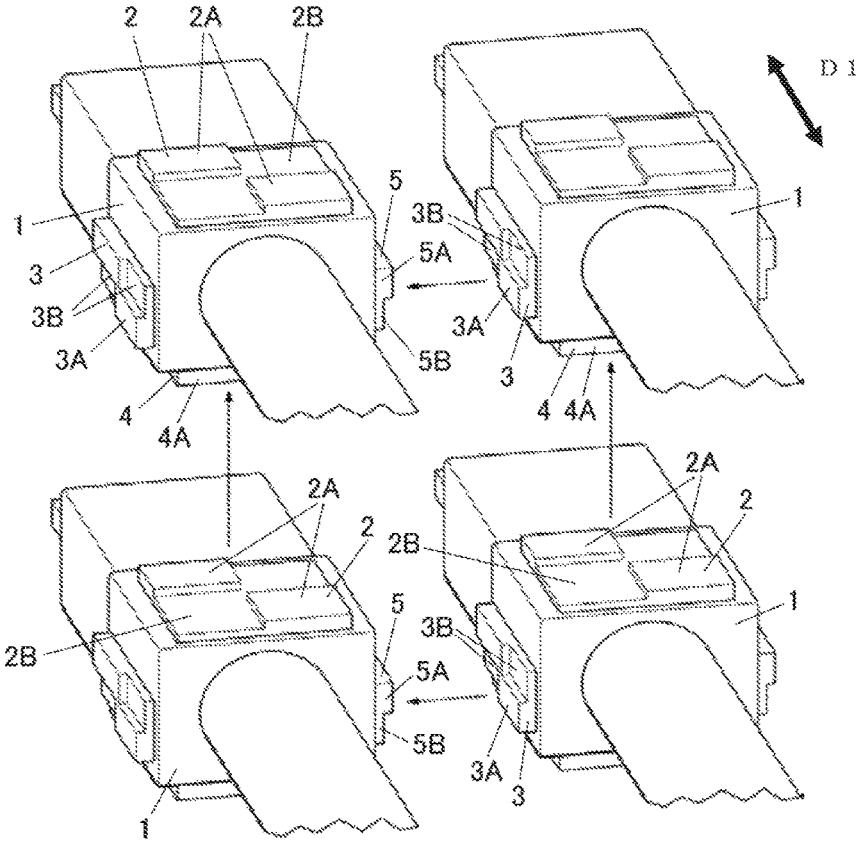
FIG. 26 PRIOR ART
FIG. 26 is a perspective view illustrating a joining operation of a plurality of connectors included in the conventional connector assembly disclosed in WO 2016/137486.

The cable unit 81 may also be connected to a small-sized personal computer 73 illustrated in FIG. 23 instead of the high-capacity personal computer 72 illustrated in FIG. 22. The personal computer 73 is a low-capacity notebook personal computer that can adequately transmit information and receive electrical power only with a single connector without the need for simultaneous use of both the first connector 51 and the second connector 61 as in the personal computer 72 illustrated in FIG. 22. The personal computer 73 includes a personal computer side connector 73A for connecting with only one of the connecting sections 52 and 62 of the first connector 51 and the second connector 61. When the cable unit 81 is to be connected to the personal computer side connector 73A of the personal computer 73, only the connecting section 62 of the second connector 61 having no floating mechanism can be connected to the personal computer side connector 73A of the personal computer 73 by joining the first connector 51 and the second connector 61 to each other at the second position, as illustrated in FIG. 23. In addition, the first connector 51 and the second connector 61 are joined to each other at the second position, and hence the first connector 51 which is not in use does not hinder the connection between the second connector 61 and the personal computer 73.

As described above, according to the connector assembly 41 in the second embodiment, the state in which the first connector 51 and the second connector 61 are joined to each other at the first position, and the state in which the first connector 51 and the second connector 61 are joined to each other at the second position can be used depending on the intended purpose.

What is claimed is:

1. A connector assembly comprising two connectors, each of which has a connecting section with a counter connector at a front end part, and is detachable in parallel toward a direction of connection with the counter connector, the two connectors comprising:

a first connector that includes a first housing having a convex portion at a side surface in a direction perpendicular to the direction of connection and a first connecting section held in the first housing; and a second connector that includes a second housing having a concave portion at a side surface in the direction perpendicular to the direction of connection and a second connecting section held in the second housing, wherein the convex portion of the first connector is fitted into the concave portion of the second connector to join the first housing and the second housing together, and wherein only one of the first connector and the second connector includes a floating mechanism, the floating mechanism allowing the first connecting section to perform floating operations with respect to the first housing in directions perpendicular to the direction of connection or allowing the second connecting section to perform floating operations with respect to the second housing in directions perpendicular to the direction of connection.

2. The connector assembly according to claim 1, wherein the floating mechanism is provided inside the first connector and allows the first connecting section to perform floating operations with respect to the first housing in directions perpendicular to the direction of connection.

3. The connector assembly according to claim 1, wherein the convex portion of the first connector is a protrusion extending along the direction of connection with its corresponding counter connector, wherein the concave portion of the second connector has a slide rail extending along the direction of connection with its corresponding counter connector and an abutment portion formed at an end of the slide rail, and wherein the protrusion of the first connector slides along the slide rail of the second connector to be abutted against the abutment portion of the slide rail, thus determining a joining position of the first housing and the second housing in the direction of connection with the counter connector.

4. The connector assembly according to claim 3, wherein the second connector has a locking spring for mechanically fixing the joining position of the first housing and the second housing.

5. The connector assembly according to claim 1, wherein the convex portion of the first connector and the concave portion of the second connector are fitted to each other in the direction perpendicular to the direction of connection with the counter connector to determine a joining position of the first housing and the second housing in the direction of connection with the counter connector, wherein one of the first connector and the second connector has a magnet and another has a ferromagnetic member, and wherein the first connector and the second connector are attracted to each other by magnetic force between the magnet and the ferromagnetic member to fix the joining position of the first housing and the second housing.

6. The connector assembly according to claim 5, wherein the convex portion of the first connector and the concave portion of the second connector are disposed so that the first housing and the second housing are joined to each other at any of a first position at which the first connecting section and the second connecting section are at positions identical to each other in the direction of connection with the counter connector, and a second position at which the first connecting section and the second connecting section are at positions different from each other in the direction of connection with the counter connector.

7. The connector assembly according to claim 6, wherein the second position is a position at which, of the first connector and the second connector, one connector having the floating mechanism is disposed at a position further away from the counter connector than another connector.

* * * * *